US010648239B2

(12) United States Patent
Elfar

(10) Patent No.: US 10,648,239 B2
(45) **Date of Patent: *May 12, 2020**

(54) DOWNHOLE PULSATION SYSTEM AND METHOD

(71) Applicant: Talal Elfar, Calgary (CA)

(72) Inventor: Talal Elfar, Calgary (CA)

( * ) Notice: Subject to any disclaimer, the term of this patent is extended or adjusted under 35 U.S.C. 154(b) by 47 days.

This patent is subject to a terminal disclaimer.

(21) Appl. No.: 16/154,703

(22) Filed: Oct. 8, 2018

(65) Prior Publication Data

US 2020/0109604 A1 Apr. 9, 2020

(51) Int. Cl.
*E21B 7/24* (2006.01)
*E21B 4/02* (2006.01)

(52) U.S. Cl.
CPC . *E21B 7/24* (2013.01); *E21B 4/02* (2013.01)

(58) Field of Classification Search
CPC ..... E21B 7/24
USPC ..... 175/56; 166/177.6
See application file for complete search history.

(56) References Cited

U.S. PATENT DOCUMENTS

| | | | |
|---|---|---|---|
| 8,181,719 | B2 | 5/2012 | Bunney et al. |
| 8,469,104 | B2 | 6/2013 | Downton |
| 9,004,194 | B2 | 4/2015 | Eddison et al. |
| 9,194,208 | B2 | 11/2015 | Schultz et al. |
| 9,273,529 | B2 | 3/2016 | Eddison et al. |
| 9,598,923 | B2 | 3/2017 | Gilleylen et al. |
| 9,702,192 | B2 | 7/2017 | Wicks et al. |
| 9,765,584 | B2 | 9/2017 | Lorenson et al. |
| 9,840,872 | B2 | 12/2017 | Schultz et al. |
| 9,840,873 | B2 | 12/2017 | Schultz et al. |
| 9,903,161 | B2 | 2/2018 | Schultz et al. |
| 9,915,183 | B2 | 3/2018 | Sealy et al. |
| 9,963,937 | B2 | 5/2018 | Prill et al. |
| 2007/0187112 | A1 | 8/2007 | Eddison et al. |
| 2010/0326733 | A1* | 12/2010 | Anderson ..... E21B 7/24 175/65 |
| 2011/0036560 | A1 | 2/2011 | Vail, III et al. |
| 2016/0194917 | A1 | 7/2016 | Alali et al. |
| 2017/0191325 | A1 | 7/2017 | Campbell |

(Continued)

FOREIGN PATENT DOCUMENTS

| | | | |
|---|---|---|---|
| CA | 2861839 | A1 | 7/2013 |
| CA | 2892254 | A1 | 7/2014 |
| CA | 2922999 | A1 | 5/2015 |

(Continued)

*Primary Examiner* — Taras P Bemko
(74) *Attorney, Agent, or Firm* — David Guerra

(57) ABSTRACT

The present technology is a downhole pulsation system for reducing friction on a drill string by generating pressure pulsations. The system includes a valve housing attachable to the drill string, and includes a housing bore for passage of fluid. A lobed insert is fittable inside the valve housing, and includes an insert bore for passage of fluid, and a lobe extending therein. A mandrel cap includes a cap bore therethrough, and at least one port in communication with the cap bore. The mandrel cap has a portion rotatably receivable in the insert bore so that the port is alignable with the lobe. A drive linkage connects the mandrel cap to a rotor of a rotor/stator drive. Fluid flow is intermittently allowed to pass from the insert bore through the port upon rotation of the mandrel cap by the rotor. Pulse frequency is controllable by changing the lobe insert or sleeve.

20 Claims, 10 Drawing Sheets

(56) References Cited

U.S. PATENT DOCUMENTS

| | | | |
|---|---|---|---|
| 2017/0254182 | A1 | 9/2017 | Gregory et al. |
| 2018/0038182 | A1 | 2/2018 | Schultz et al. |

FOREIGN PATENT DOCUMENTS

| | | | |
|---|---|---|---|
| CA | 2872736 | C | 12/2015 |
| CA | 2960699 | A1 | 3/2016 |
| CA | 2780236 | C | 7/2016 |
| CA | 2680895 | C | 5/2017 |
| CA | 2892971 | C | 9/2017 |
| CA | 2985258 | A1 | 5/2018 |
| WO | 2017197442 | A1 | 11/2017 |

* cited by examiner

DOWNHOLE PULSATION SYSTEM AND METHOD

BACKGROUND

Technical Field

The present technology relates to a downhole pulsation system and method for use in connection with reducing friction acting on a tool string and/or advancing the tool string by generating and utilizing pressure pulsations.

Background Description

Conventional oil and gas drilling involves the rotation of a drill string at the surface which rotates a drill bit mounted to the bottom of the drill string. It is known that to access sub-surface hydrocarbon formations by drilling long bore holes into the earth from the surface. Conventional systems includes advancing a drill bit along the hole, with the drill bit being mounted at the end of a bottom hole assembly (BHA).

During the advancing of the drill bit, friction between the BHA and the well sides can impair the advancing of the drill bit, and in some cases the BHA can get stuck in the well. This is more the case when drilling angled or horizontal holes. In some circumstances, the weight of the drill string is not sufficient to overcome the friction.

In other drilling operations, a motor may be used to rotate the drill bit. Coiled or flexible tubing can be utilized in many downhole operations, but due to its inherent transverse flexibility, coiled tubing in generally more susceptible to buckling than rigid strings consisting of threadably connected tubulars. One solution to this known disadvantage in coiled tubing is to use extended reach tools in conduction with coiled tubing.

Situations occur where it is more difficult to advance the drill bit in a hydrocarbon formation. These situations can occur during horizontal drilling operations wherein additional loads are placed on the coiled tubing. It is common during some operations that friction lock-up occurs and the entire drill string can get stuck in the well.

The use of cavitation devices are known, such as casing reamer shoes, multi-part stators and counter-weighted devices, to create a pulsation or vibration at the BHA to assist in advancement through the earth or to free the BHA. These known cavitation or vibration devices are not capable of providing controlled, tunable pressure pulses, using a stator rotor configuration. Some of these known cavitation or vibration devices are further not capable of being utilized with coiled tubing.

While the above-described devices fulfill their respective, particular objectives and requirements, the aforementioned patents do not describe a downhole pulsation system and method that allows reducing friction acting on a tool string by generating and utilizing pressure pulsations.

Therefore, a need exists for a new and novel downhole pulsation system and method that can be used for reducing friction acting on a tool string by generating and utilizing pressure pulsations. In this regard, the present technology substantially fulfills this need. In this respect, the downhole pulsation system and method according to the present technology substantially departs from the conventional concepts and designs of the prior art, and in doing so provides an apparatus primarily developed for the purpose of reducing friction acting on a tool string by generating and utilizing pressure pulsations.

BRIEF SUMMARY OF THE PRESENT TECHNOLOGY

In view of the foregoing disadvantages inherent in the known types of cavitation devices now present in the prior art, the present technology provides a novel downhole pulsation system and method, and overcomes the above-mentioned disadvantages and drawbacks of the prior art. As such, the general purpose of the present technology, which will be described subsequently in greater detail, is to provide a new and novel downhole pulsation system and method and method which has all the advantages of the prior art mentioned heretofore and many novel features that result in a downhole pulsation system and method which is not anticipated, rendered obvious, suggested, or even implied by the prior art, either alone or in any combination thereof.

According to one aspect of the present technology, the present technology essentially includes a downhole pulsation system for utilization with a drill string. The system comprising a valve sub housing attachable to the drill string. The valve sub housing can include a sub bore axially extending along a longitudinal axis therethrough and configured to allow fluid to pass therethrough. A lobed insert can be fittable to the valve sub housing and locatable inside the sub bore. The lobed insert can include an insert bore axially extending along a longitudinal axis therethrough and configured to allow fluid to pass therethrough, and at least one lobe feature extending into the insert bore. A mandrel cap can include a cap bore axially extending along a longitudinal axis therethrough and configured to allow fluid to pass therethrough, and at least one port defined through the mandrel cap in communication with the cap bore. The mandrel cap can include a portion thereof rotatably receivable in the insert bore of the lobed insert so that the port is alignable with the lobe feature. At least one drive linkage can be operably connected to the mandrel cap to a rotor of a lobed rotor and stator assembly. The lobed insert or the mandrel cap can be configured to intermittently allow fluid to pass from the insert bore through the port upon rotation of the mandrel cap by the rotor.

According to another aspect of the present technology, the present technology essentially includes downhole pulsation system for utilization with a drill string. The system comprising a valve assembly including a valve sub housing attachable to the drill string, a lobed insert fittable to the valve sub housing and locatable inside the sub bore, and a mandrel cap rotatably received at least in the valve sub housing. The valve sub housing can include a sub bore axially extending along a longitudinal axis therethrough and configured to allow fluid to pass therethrough. The lobed insert can include an insert bore axially extending along a longitudinal axis therethrough and configured to allow fluid to pass therethrough, and at least one lobe feature extending into the insert bore. The mandrel cap can include a cap bore axially extending along a longitudinal axis therethrough and configured to allow fluid to pass therethrough, and at least one port defined through the mandrel cap in communication with the cap bore. The mandrel cap can have a portion thereof rotatably receivable in the insert bore of the lobed insert so that the port is alignable with the lobe feature. A mandrel can be connectable to the mandrel cap, and can include a mandrel bore axially extending along a longitudinal axis therethrough and configured to allow fluid to pass therethrough from said cap bore, and at least one mandrel port defined through the mandrel in communication with the mandrel bore. The mandrel port can be configured to allow fluid to pass from the mandrel bore to an annulus defined exterior of at least a portion of the mandrel defining the mandrel port. At least one drive linkage can be connectable to the mandrel. A rotor can be connectable to the drive linkage, and the rotor can have at least one rotor lobe. A stator can be connectable to the bottom hole assembly, and the stator can include a stator bore axially extending along a longitudinal axis therethrough and configured to allow fluid to pass therethrough, and at least one stator lobe. The stator bore can be configured receive the rotor. The lobed insert or the mandrel cap can be configured to intermittently allow fluid to pass from the insert bore through the port upon rotation of the mandrel cap by the rotor.

According to yet another aspect of the present technology, the present technology essentially includes a method of creating drill string pulsation utilizing a downhole pulsation system. The method can comprise the steps of receiving a working fluid to a sub bore axially defined along a longitudinal axis of a valve sub housing from an axial bore of a drill string coupled to said valve sub housing. Working fluid can then be received to a cap bore defined along a longitudinal axis of a mandrel cap that is rotatably received in an insert bore of a lobed insert located in the sub bore of the valve sub housing. The working fluid can then flow through the cap bore and to a mandrel bore axially defined along a longitudinal axis of a mandrel coupled to the mandrel cap. The working fluid can then flow from the mandrel bore through at least one mandrel port that is in communication with the mandrel bore and an annulus defined exterior of at least a portion of the mandrel defining the mandrel port. A rotor can be rotated within a stator bore of a stator utilizing the flowing of the working fluid through the stator bore. The rotor can be connected to the mandrel. The mandrel cap can be rotated by the rotation of the rotor so that a mandrel port is intermittently obstructed by a lobe feature of the lobe insert.

Some aspects of the present technology may also include a sleeve including a sleeve bore axially extending along a longitudinal axis therethrough, and at least one sleeve port defined through the sleeve in communication with the sleeve bore. The sleeve bore can be configured to receive the portion of the mandrel cap defining the port so that the sleeve port is aligned with and in communication with the port of the mandrel cap when the sleeve is assembled on the mandrel cap. There are, of course, additional features of the present technology that will be described hereinafter and which will form the subject matter of the claims attached.

In some embodiments, the present technology can include a mandrel connectable to the mandrel cap and the drive linkage. The mandrel can include a mandrel bore axially extending along a longitudinal axis therethrough and configured to allow fluid to pass therethrough, and at least one mandrel port defined through the mandrel in communication with the mandrel bore and configured to allow fluid to pass from the mandrel bore to an annulus defined exterior of at least a portion of the mandrel defining the mandrel port.

In some embodiments, the drive linkage can be a drive shaft. Further embodiments of the present technology can include the drive shaft as configured to have a predetermined transverse flexibility characteristic.

Some embodiments of the present technology can have the mandrel rotatably supported inside the sub bore of the valve sub housing or inside an axial bore of a second housing that is attachable to the valve sub housing by way of one or more bearings.

Some embodiments can include at least one seal element configured to prevent fluid from entering an annulus downstream of the mandrel cap.

In some embodiments, the present technology can include at least one seal element concentrically located exterior of the mandrel. The seal element can be configured to prevent fluid from entering the annulus defining an exterior of the portion of the mandrel defining the mandrel port.

Some embodiments of the present technology can include a sleeve having a sleeve bore axially extending along a longitudinal axis therethrough, and at least one sleeve port defined through the sleeve in communication with the sleeve bore. The sleeve bore can be configured to receive the portion of the mandrel cap defining the port so that the sleeve port is aligned with and in communication with the port of the mandrel cap when the sleeve is assembled on the mandrel cap.

In some embodiments, the sleeve cam include at least one notch defined in an end of the sleeve. The notch can be configured to receive a member protruding from the mandrel cap to prevent rotation of the sleeve about the mandrel cap.

Some embodiments of the present technology can include a collar having a collar bore axially extending along a longitudinal axis therethrough and configured to receive the mandrel cap and secure the sleeve in position on the mandrel cap.

In some embodiments, a narrowed section can be configured in at least one selected from the group consisting of the sub bore, and the cap bore. The narrowed section can be configured to restrict flow of fluid passing therethrough, respectively.

In some embodiments, the lobe feature of the lobe insert is a plurality of lobe features radially arranged and extending into the insert bore.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology.

BRIEF DESCRIPTION OF THE DRAWINGS

The present technology will be better understood and objects other than those set forth above will become apparent when consideration is given to the following detailed description thereof. Such description makes reference to the annexed drawings, with phantom lines depicting environmental structure and forming no part of the claimed present technology, wherein:

The same reference numerals refer to the same parts throughout the various figures.

DETAILED DESCRIPTION OF THE PREFERRED EMBODIMENTS

Figure 1:
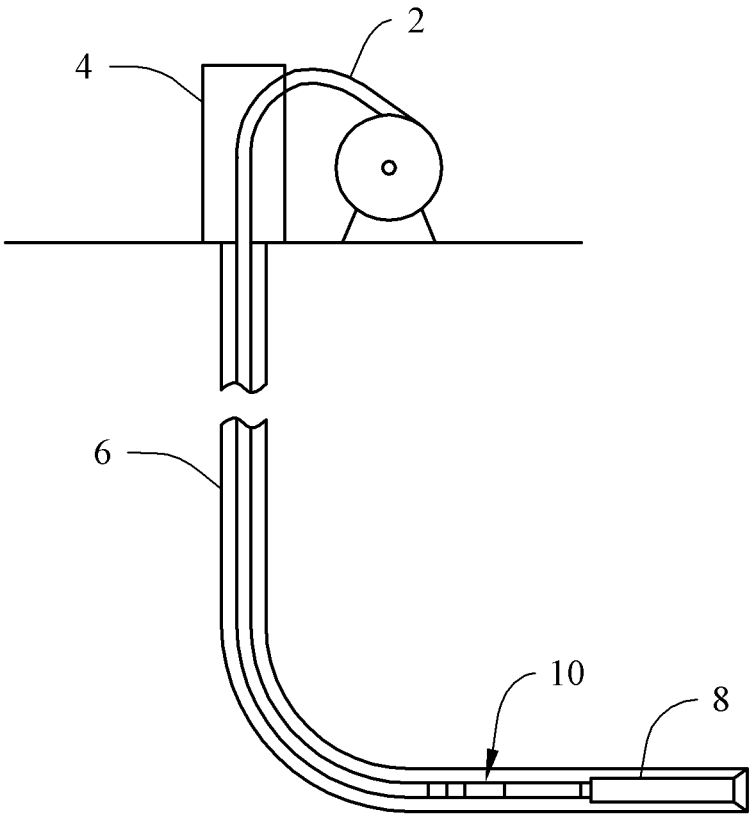
FIG. 1 illustrates a well site system utilizing an embodiment of the downhole pulsation system and method constructed in accordance with the principles of the present technology.

Referring now to the drawings, and particularly to FIGS. 1-18, an embodiment of the downhole pulsation system and method of the present technology is shown and generally designated by the reference numeral 10.

In FIG. 1, a new and novel downhole pulsation system and method 10 of the present technology for reducing friction acting on a tool string and/or advancing the tool string by generating and utilizing pressure pulsations is illustrated and will be described. In the exemplary, the downhole pulsation system and method 10 can be utilized with a coiled tubing 2 that is associated with a bottom hole assembly (BHA) 8 in a wellbore 6. In typical operation, the coiled tubing 2 is run through a well head assembly 4 for insertion into the wellbore 6. It can be appreciated that the present technology can be utilized with jointed drill pipe or other drill string systems. The coiled tubing can provide fluid, hydraulic, electrical or communications to the BHA 8, and also provides a mechanical drive force to advance and retrieve the BHA 8 from the wellbore 6. The BHA 8 can include, but not limited to, a mud motor, a positive displacement motor (PDM), a measurement while drilling (MWD) tool, telemetry systems or other downhole tool assemblies.

Some benefits and advantages of downhole pulsation system and method 10 can be that it reduces the friction acting on a tool string, such as the coiled tubing 2, being conveyed through a vertical or non-vertical wellbore 6, by way of the generation of pressure pulsations (vibrations). In doing this, the tool string 2 can be conveyed or advanced further along the wellbore 6 before friction lock-up occurs.

In the oilfield industry, lock-up is known as a condition that may occur when a coiled tubing string is run into a horizontal (non-vertical) or highly deviated wellbore. Lock-up occurs when the frictional force encountered by the string running on the wellbore tubular reaches a critical point. Although more tubing may be injected into the wellbore, the end of the tool string cannot be moved farther into the wellbore. Helical buckling of the coiled tubing in the wellbore can be disastrous result of a lock-up condition. Coiled tubing, due to its inherent transverse flexibility, is generally more prone to buckling than strings consisting of threadably connected tubulars or jointed pipes.

Figure 2:
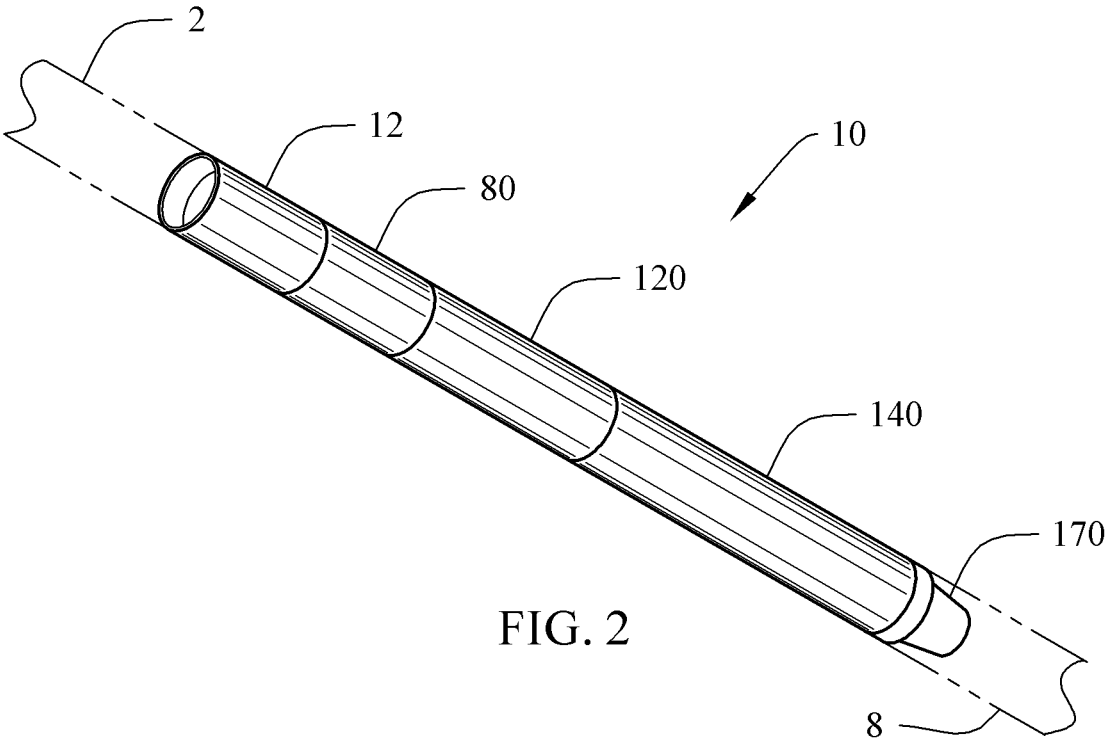
FIG. 2 is a perspective view of an assembled downhole pulsation system of the present technology.
Figure 3:
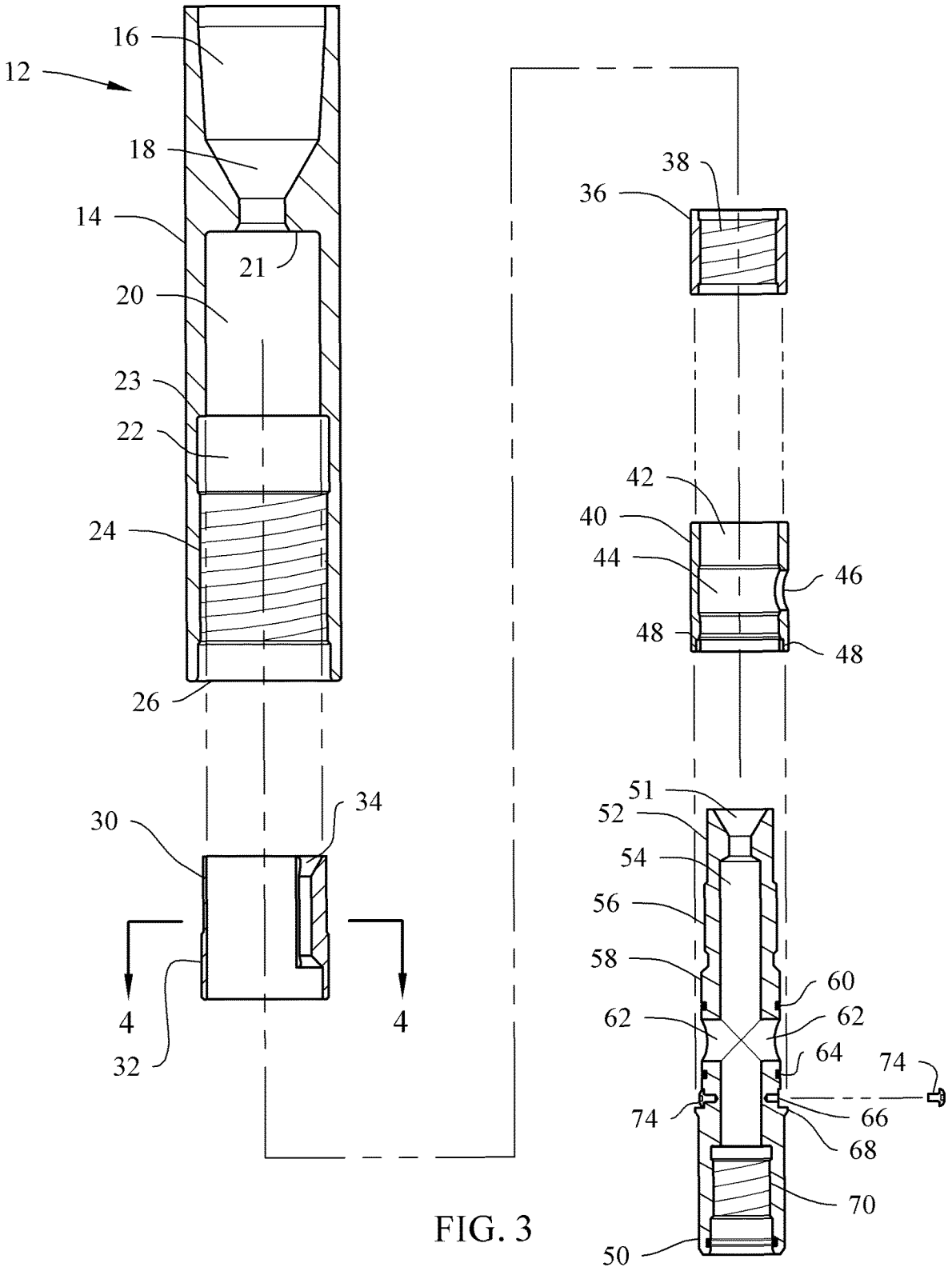
FIG. 3 is an exploded cross-sectional view of the valve sub assembly of the present technology.

Referring to FIG. 2, the downhole pulsation system 10 can include a plurality of assembly connected together to create a single system that is attachable to the coiled tubing 2 and the BHA 8. The downhole pulsation system 10 can include a valve sub assembly 12, a bearing housing assembly 80, a flex shaft housing assembly 120, a rotor/stator assembly 140 and a bottom sub 170. The downhole pulsation system 10, when assembled, can have a smooth outer surface with a diameter less than the wellbore 6, so it can easily be conveyed through the wellhead system 4 and wellbore 6.

The valve sub assembly 12, as best illustrated in FIGS. 3-6, can include a top or valve sub housing 14, a lobed insert 30, a threaded collar 36, a ported sleeve 40, and a mandrel cap 50. The top sub housing 14 defines an axial bore or cavity therethrough, and includes a box connection 16 with internal threading that is capable of engaging with a pin connection of the coiled tubing 2 or other downhole tool. The internal cavity includes a narrowing section 18 that transitions from the box connection 16, which reduces the diameter of the cavity. A main cavity section 20 then transitions from the narrowing section 18, and has a diameter larger than an end of the narrowing section 18, thereby creating a stop edge wall 21.

A secondary cavity section 22 can transition from the main cavity section 20, and which has a diameter larger than the main cavity section 20, thereby creating a stop edge wall 23. Internal threading of a second connection end 24 can be associated with a portion of the secondary cavity section 22. An open end 26 can be adjacent the internal threading of the second connection end 24.

Figure 4:
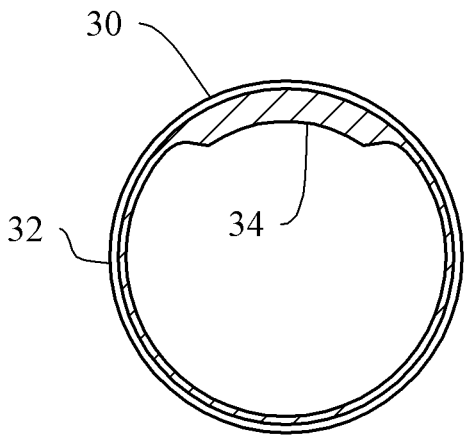
FIG. 4 is a cross-sectional view of the lobed insert of the present technology, taken along line 4-4 in FIG. 3.

The lobed insert 30 defines an axial insert bore or cavity therethrough, and has a diameter allowing it to be received in the secondary cavity section 22 and not the main cavity section 20. The lobed insert 30 includes an external threading portion 32 that is capable of engaging with the internal threading of the second connection end 24, thereby constraining the lobed insert 30 to the top sub housing 14. Extending into the cavity of the lobed insert 30 is at least one lobe feature 34 that projects from an internal surface of the lobed insert 30, as best illustrated in FIG. 4. When assembled, an end of the lobed insert 30 can contact the stop edge 23 of the secondary cavity section 22, thereby securing the lobed insert 30 in place and preventing it from being received in the main cavity section 20. The lobed insert 30 can include interior notches or surfaces that are capable of receiving a tool end for assistance in removal and/or installation of the lobed insert 30 within the secondary cavity section 22 and not the main cavity section 20. It can be appreciated that the lobed insert 30 can include multiple lobe features 34, each with the same or varying thickness, and with the same or varying surface configurations.

Figure 5:
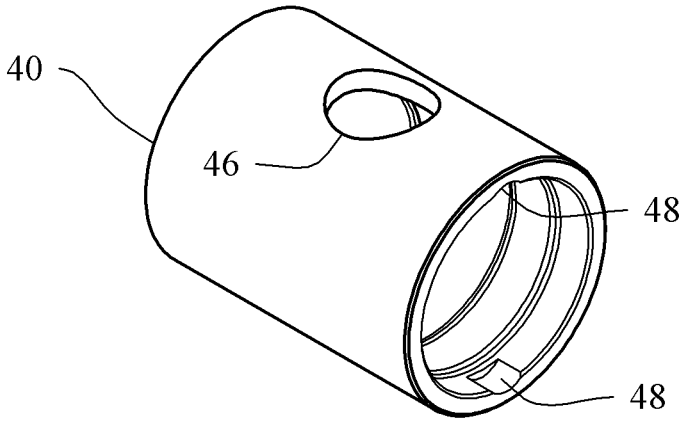
FIG. 5 is a perspective view of the single port sleeve of the present technology.

The ported sleeve 40, as best illustrated in FIG. 5, defines an axial sleeve bore or cavity 42 therethrough, and has a diameter allowing it to be received through the lobed insert 30. The ported sleeve 40 defines a port cavity section 44 in communication with the cavity 42, and at least one port 46 defined through the sidewall of the sleeve 40 and in communication with the port cavity section 44. It can be appreciated that the ported sleeve 40 can include multiple ports 46, each with the same or varying sized openings.

The port cavity section 44 can have a diameter larger than the cavity 42. An end of the sleeve 40, opposite the internal threading section 44, is an open end with notches 48 defined in an internal surface of the sidewall and in communication with the cavity 42 and exterior of the sleeve 40.

Figure 6:
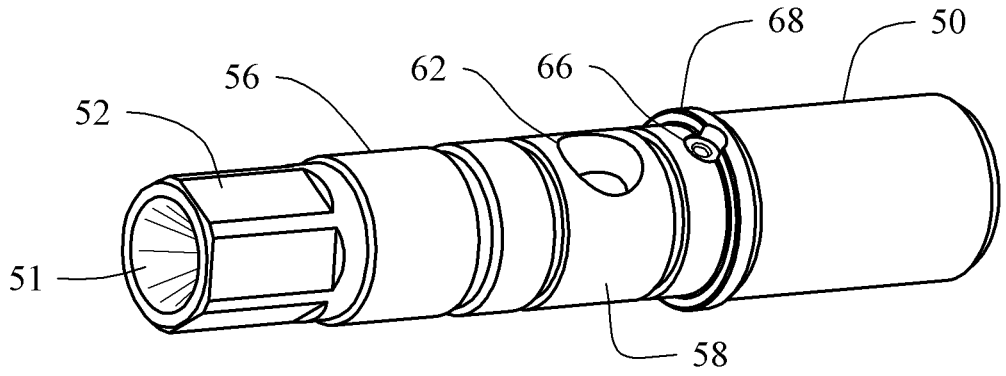
FIG. 6 is a perspective view of the mandrel cap of the present technology.

The mandrel cap 50, as best illustrated in FIG. 6, defines an axial cap bore or cavity therethrough, and includes a first end section 52 featuring exterior planar surfaces, and defining a narrowing cavity section 51. The first end section 52 has a diameter allowing it to be received through the ported sleeve 40 and in the main cavity section 20 of the top sub housing 14, when assembled. The exterior planar surfaces can be arranged to create a geometrical configuration capable of being engaged with a tool for installation, removal or manipulation of the mandrel cap 50.

Adjacent to the first end section 52 is an external threading section 56 capable of engaging with internal threading 38 of the collar 36.

A main cavity section 54 transitions from the narrowing cavity section 51, and has a diameter larger than an end of the narrowing cavity section 51.

Following the external threading section 56 is a port section 58, which includes one or more ports 62 are defined through the sidewall of the port section 58, and are in communication with the cap cavity 54. It can be appreciated that any number, size and configuration of ports 62 can be utilized. The port section 58 has diameter the same or larger than the first end section 52 or the external threading section 56. The diameter of the port section 58 allows it to be slidably and rotatably received in the ported sleeve 40, so that the port 46 of the ported sleeve 40 is alignable with at least one of the ports 62. Seals 60, 64 can be utilized on the exterior of the port section 58 on either side of the ports 62 to provide fluid tight seal against an interior surface of the ported sleeve 40, when assembled.

The port section 58 can include threaded bores 66 defined therein, each configured to engage with and receive a fastener 74. The number and location of the bores 66 correspond with the number and location of the notches 48 of the ported sleeve 40. When the ported sleeve 40 is assembled with the mandrel cap 50, a head of each of the fasteners 74 is received in a corresponding notch 48, respectively. This can further prevent the ported sleeve 40 from rotating freely with respect to the mandrel cap 50. It can be appreciated that pins, detents, latches, and the like can be used in place of the fastener 74.

Adjacent to the bores 66 is a lip 68 extending outward from an exterior the mandrel cap 50. It can be appreciated that the lip 68 can be a radial lip or at least one projection or tab. The lip 68 has a diameter or height sufficient to produce a stop edge that can contact or abut the end of the ported sleeve 40 when assembled. The mandrel cap 50 includes a second connection end 70 featuring internal threading adjacent to an end thereof.

Figure 7A:
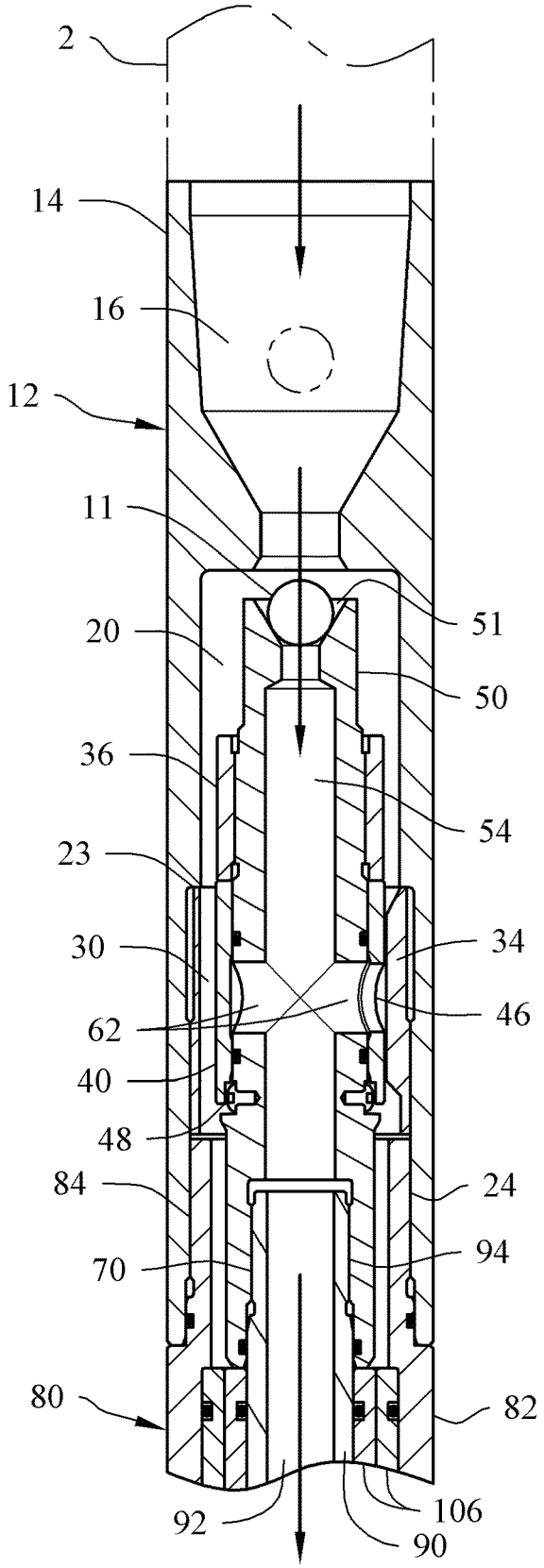
FIGS. 7A and 7B are cross-sectional views of the valve sub assembly in a valve closed (FIG. 7A) and valve open (FIG. 7B).
Figure 7B:
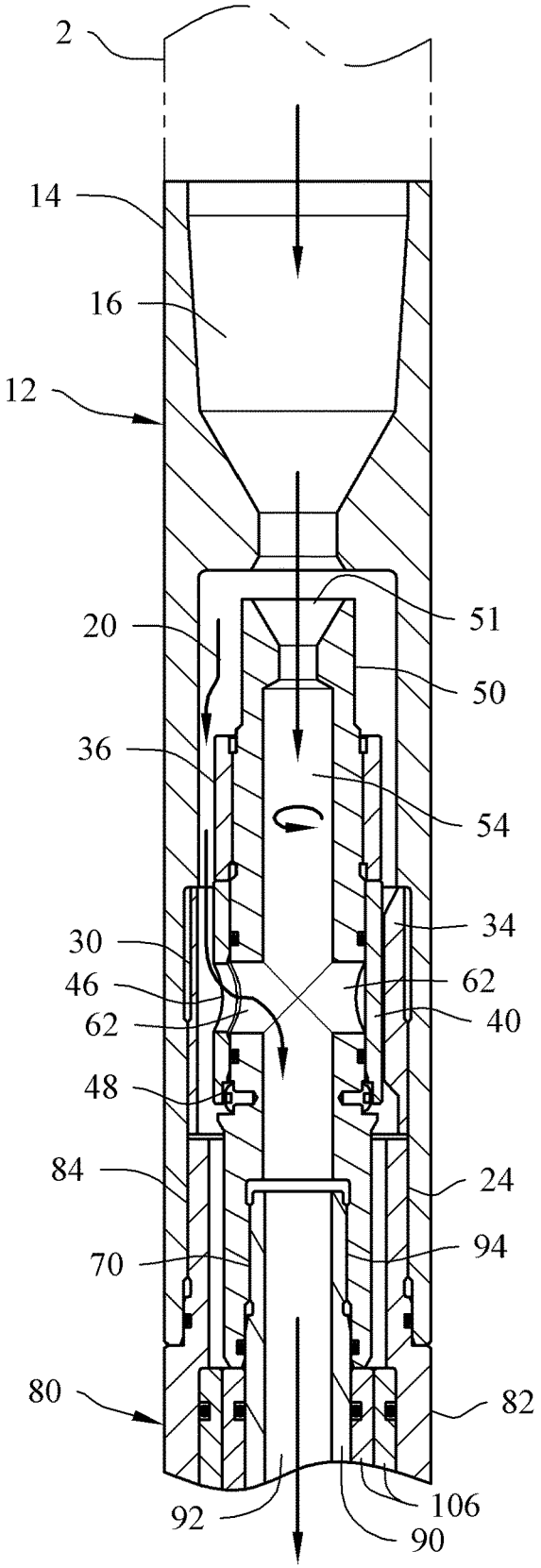

The assembled valve assembly is best illustrated in FIGS. 7A and 7B, which includes the lobed insert 30 securely fitted to the internal threading of the second connection end 24 of the top sub housing 14 so that an end of the lobed insert 30 contacts or is adjacent to the stop edge 23.

The ported sleeve 40 is slidably positioned over the first end section 52 of the mandrel cap 50 and then onto the port section 58 so that the notches 48 receive the heads of the fasteners 74 and the port 46 of the ported sleeve 40 is aligned with at least one of the ports 62 of the mandrel cap 50. Then the collar 36 is slidably received over the first end section 52 and then securely fitted to the external threading section 56 of the first end section 52. The collar 36 can be rotatably engaged with the external threading section 56 to squeeze or clamp the ported sleeve 40 to the mandrel cap 50.

The top sub housing 14 and lobed insert 30 can slidably receive the collar 36, ported sleeve 40 and mandrel cap 50 so that the port 46 of the ported sleeve 40 is aligned with the lobe feature 34 and rotatable within the lobed insert 30. The lobe feature 34 is configured and in sufficient radial proximity to the port 46, to significantly obstruct the passage of fluid into the port 46, as they pass by each other during rotation of the mandrel cap 50, as best illustrated in FIG. 7A. Accordingly, only allowing fluid to pass from the narrowing section 18 or main cavity section 20 of the top sub housing 14 into the open end or narrowing cavity section 51 of the mandrel cap. The lobe feature 34 can have a cylindrical surface that is oriented concentrically with respect to a rotation axis of the mandrel cap 50. The port 46 resides on a cylindrical surface that is oriented concentrically with respect to this rotation axis.

During rotation of the mandrel cap 50, the port 46 will cyclically pass by the lobe feature 34, consequently created cyclic obstruction and non-obstruction of the port 46. During non-obstruction of the port 46 by the lobe feature 34, as best illustrated in FIG. 7B, fluid can freely pass from the main cavity section 20 (annulus between the mandrel cap 50 and the top sub housing 14) of the top sub housing 14 into the port 46 of the ported sleeve 40 and through the port 62 of the mandrel cap 50, and then into the cap cavity 54 of the mandrel cap 50.

The bearing housing assembly 80 includes a bearing housing 82 defining an axial bearing housing bore or cavity therethrough. The bearing housing 82 includes a first connection end 84 featuring external threading capable of being engageable with the internal threading of the second connection end 24 of the top sub housing 14, thereby joining the bearing housing 82 and the top sub housing 14. It can be appreciated that seals can be utilized between the first connection end 84 of the bearing housing 82 and the second connection end 24 of the top sub housing 14. The axial cavity of the bearing housing 82 includes a main cavity section that has a diameter greater than a section of the cavity associated with at least the first connection end 84, thereby creating a stop edge.

Figure 8:
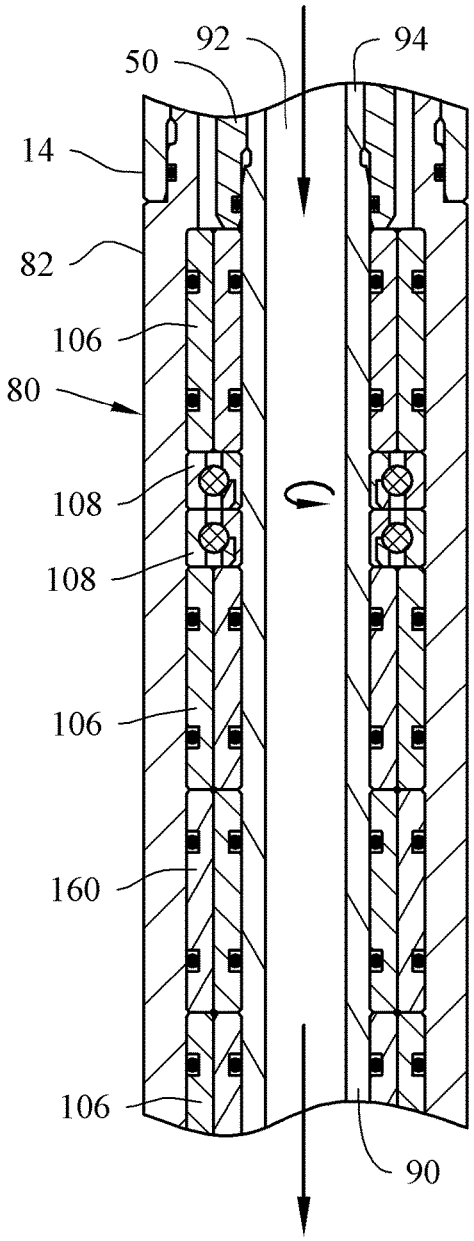
FIG. 8 is a cross-sectional view of the bearing housing assembly with the mandrel of the present technology.
Figure 9:
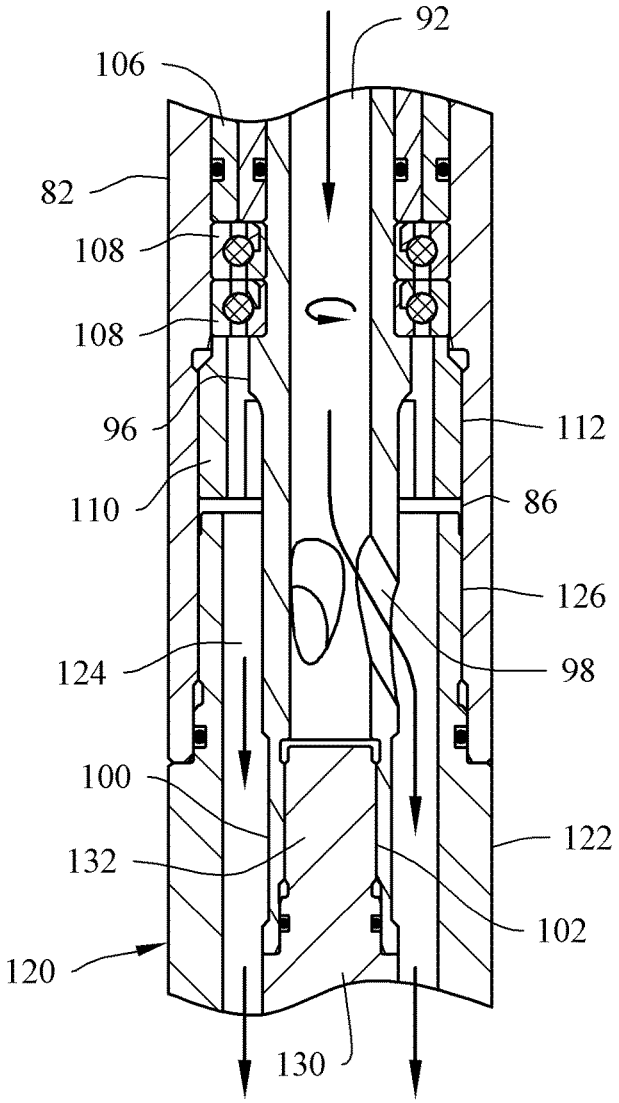
FIG. 9 is a cross-sectional view of the bearing housing assembly and flex shaft housing assembly with the mandrel and flex shaft of the present technology.

The bearing housing assembly 80 further includes a plurality of seal elements 106 and bearings 108, as best illustrated in FIGS. 8 and 9, axially aligned in a stack configuration and configured to slidably and rotatably receive at least a portion of a mandrel 90. The seal elements 106 can be a set of concentric seals including an exterior seal capable of contacting an interior surface of the bearing housing 82, and an interior seal capable of contacting an exterior surface of a portion of the mandrel 90. The seal elements 106 can be configured to prevent fluid from bypassing a mandrel bore 92 and entering an annulus downstream thereof. The seals utilized in the seal elements 106 can be, but not limited to, O-ring seals made of nitrile or any sealing material utilizable in downhole operations. The bearings 108 can be, but not limited to, a ball bearing, a roller bearing, a plain bearing, a jewel bearing, a fluid bearing, a magnetic bearing, a flexure bearing and the like. In the exemplary, a first seal element 106 is positioned against the stop edge of the bearing housing 82, and adjacent thereto a first bearing set 108 is located. Multiple seal elements 106 can then be positioned adjacent the first bearing set 108, and adjacent thereto can be a second bearing set 108.

The bearing housing 82 can include a second connection end 86 featuring internal threading. A bearing race nut 110 can be received through the second connection end 86 and into the cavity of the bearing housing 82. The bearing race nut 110 can include external threading 112 configured to be engageable with the internal threading of the second connection end 86. The bearing race nut 110 includes an end configured to contact the last sealing bearing 106 or last bearing set 108, respectively depending on the seal element and bearing configuration, when assembled, and clamp all the seal elements 106 and bearings 108 against the stop edge of the bearing housing 82, thereby securing them in place. The bearing race nut 110 can include interior notches or surfaces that is capable of receiving a tool end for assistance in removal and/or installation of the race nut 110 within the bearing housing 82.

Figure 10:
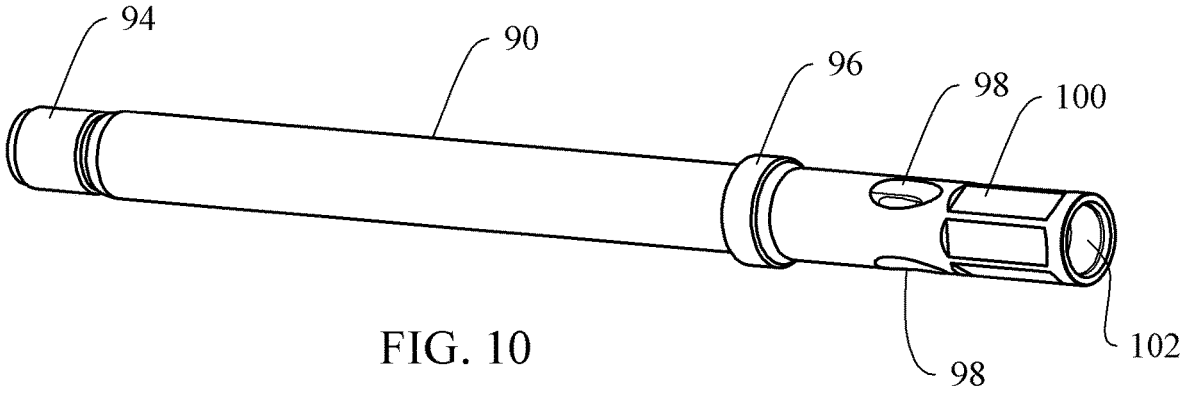
FIG. 10 is a perspective view of the mandrel of the present technology.

The mandrel 90, as best illustrated in FIG. 10, can include a first connection end 94 featuring external threading, a lip 96, a plurality of ports 98, and a second end section 100 featuring exterior planar surfaces. The exterior planar surfaces of the second end section 100 can be arranged to create a geometrical configuration capable of being engaged with a tool for installation, removal or manipulation of the mandrel 90. The mandrel 90 defines an axial mandrel bore or cavity 92 therethrough configured to allow fluid to pass through the mandrel 90. The mandrel 90 is configured to be slidably and rotatably received through the seal elements 106 and bearings 108 so that the external threading of the first connection end 94 is engageable with the internal threading of the second connection end 70 of the mandrel cap 50, thereby coupling the mandrel 90 to the mandrel cap 50. It can be appreciated that seals can be utilized between the first connection end 94 of the mandrel 90 and the second connection end 70 of the mandrel cap 50.

It can be appreciated, as best illustrated in FIGS. 7A and 7B, that the mandrel bore 92 of the mandrel 90 is substantially aligned with the cap cavity 54 of the mandrel cap 50, so that fluid passing through the mandrel cap 50 is capable of passing through the mandrel 90.

The mandrel 90 further includes a lip 96 extending outward from an exterior of the mandrel 90. It can be appreciated that the lip 96 can be a radial lip or at least one projection or tab. The lip 96 has a diameter or height sufficient to produce a stop edge that can contact or abut against the last sealing element 106 or last bearing set 108, respectively depending on the seal element and bearing configuration.

A portion of the mandrel 90 part of or near the second end portion 100 includes one or more angled ports 98 defined through the sidewall of the mandrel 90. Adjacent to or part of the second end portion 100 of the mandrel 90 is a second connection end 102 that includes internal threading, and is configured to create an annulus between the bearing housing 82 or the flex shaft housing assembly 120. The ports 98 can be provided at circumferentially spaced positions about a longitudinal axis of the mandrel 90 in which each port 98 extends radially outward for communication between the mandrel bore 92 and the surrounding annulus of the bearing housing 82 or the flex shaft housing assembly 120. Each of the ports 98 can be angled in the direction of fluid flow, as best illustrated in FIG. 9.

Figure 11:
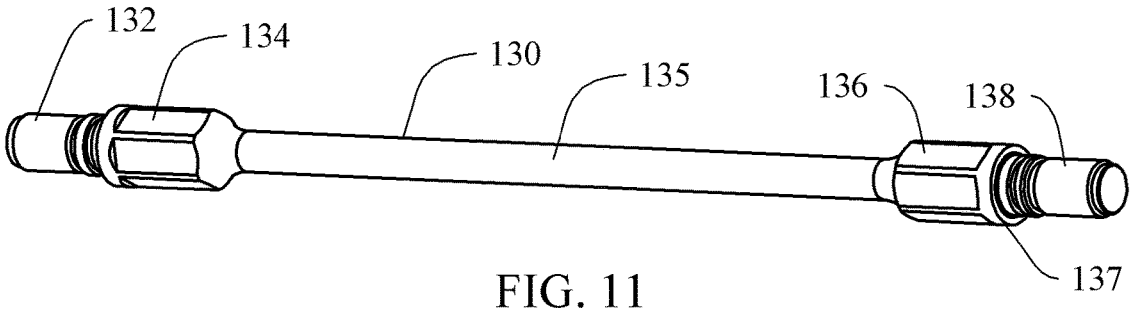
FIG. 11 is a perspective view of the flex shaft of the present technology.
Figure 12:
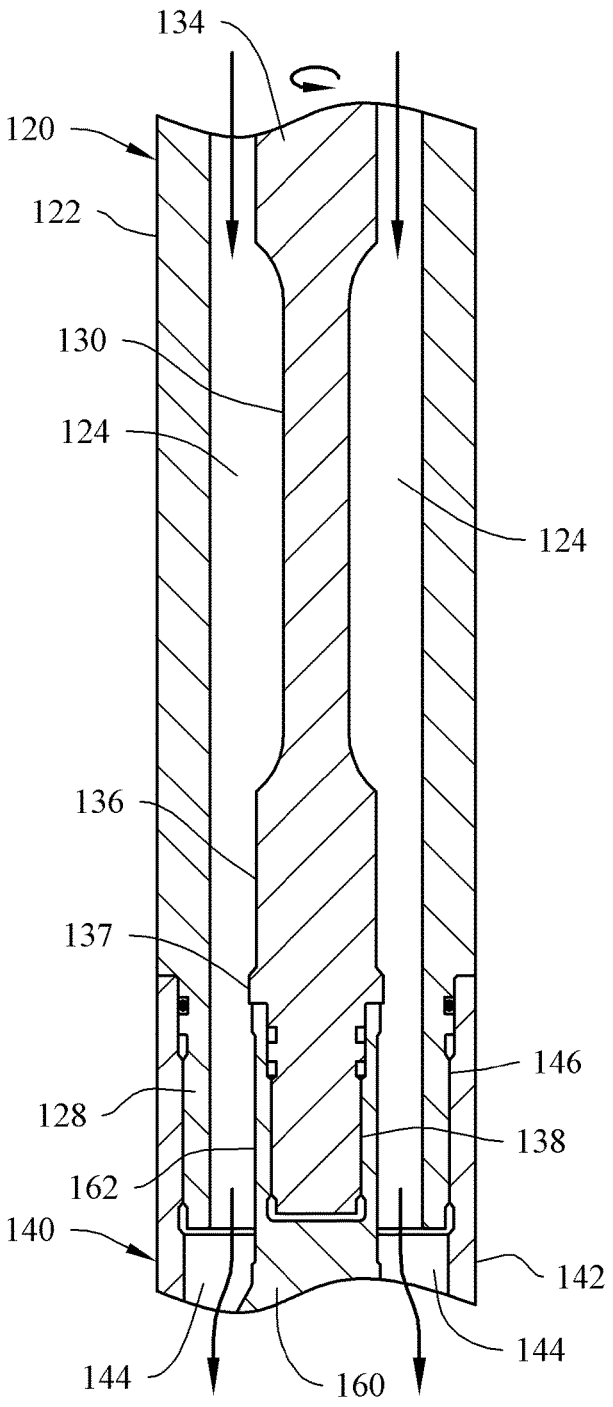
FIG. 12 is a cross-sectional view of the flex shaft housing assembly with the flex shaft of the present technology.

Referring now to FIGS. 9, 11 and 12, the flex shaft housing assembly 120 includes a flex shaft housing 122 defining an axial flex shaft housing bore or cavity 124 therethrough. The flex shaft housing 122 can include a first connection end 126 featuring external threading capable of being engageable with the internal threading of the second connection end 86 of the bearing housing 82, thereby joining the bearing housing 82 and the flex shaft housing 122. It can be appreciated that seals can be utilized between the first connection end 126 of the flex shaft housing 122 and the second connection end 86 of the bearing housing 82.

A drive shaft or flex shaft 130, as best illustrated in FIG. 11, can include a first connection end 132 featuring external threading, a first set of exterior planar surfaces 134 part of or adjacent with the first connection end 132, a shaft section 135, a second set of exterior planar surfaces 136, and a second connection end 138 featuring external threading. The second set of planar surfaces 136 can be part of or adjacent with the second connection end 138.

The flex shaft 130 is receivable in the flex shaft housing bore 124 of the flex shaft housing 122, and is configured to create an annulus between the flex shaft 130 and the flex shaft housing 122, thereby allowing fluid from the ports 98 to travel therethrough pass the flex shaft 130.

The external threading of the first connection end 132 is capable of being engageable with the internal threading the second connection end 102 of the mandrel 90, thereby joining the mandrel 90 and the flex shaft 130. It can be appreciated that seals can be utilized between the first connection end 94 of the flex shaft 130 and the second connection end 102 of the mandrel 90.

The first and second set of external planar surfaces 134, 136 can be arranged to create a geometrical configuration capable of being engaged with a tool for installation, removal or manipulation of the flex shaft 130.

The flex shaft 130 is configured or capable of undergoing nutation as well as rotation, this can be accomplished with the flex shaft 130 having sufficient transverse flexibility. The shaft section 135 can have a diameter less than the first and second ends or sufficient enough to provide the transverse flexibility required of the present technology.

Figure 13:
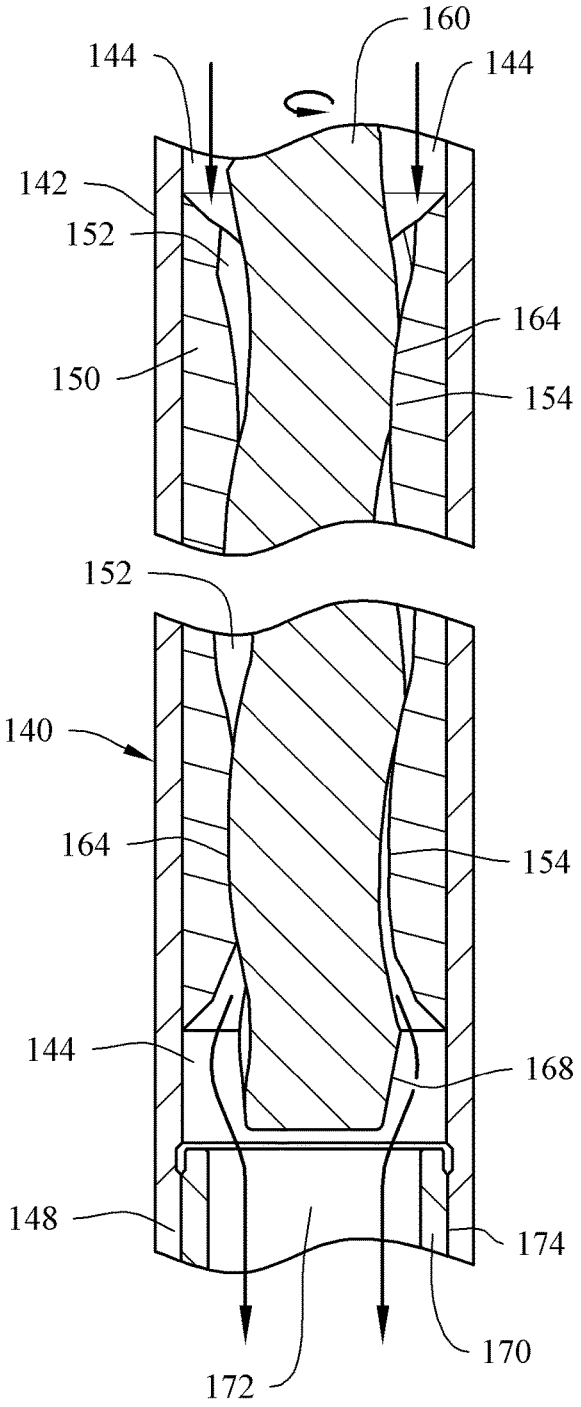
FIG. 13 is a cross-sectional view of the rotor/stator assembly with the stator and rotor of the present technology.
Figure 14:
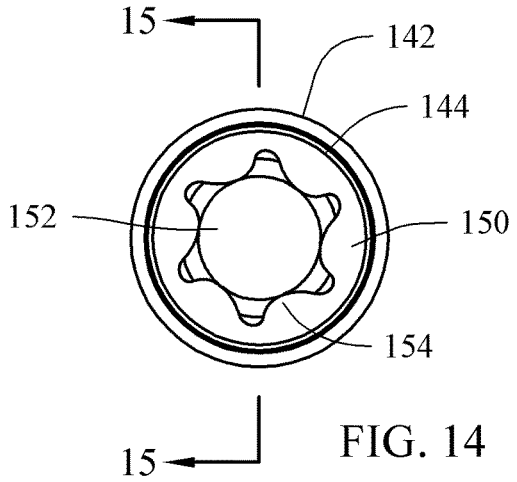
FIG. 14 is a side view of the stator housing with the stator of the present technology.
Figure 15:
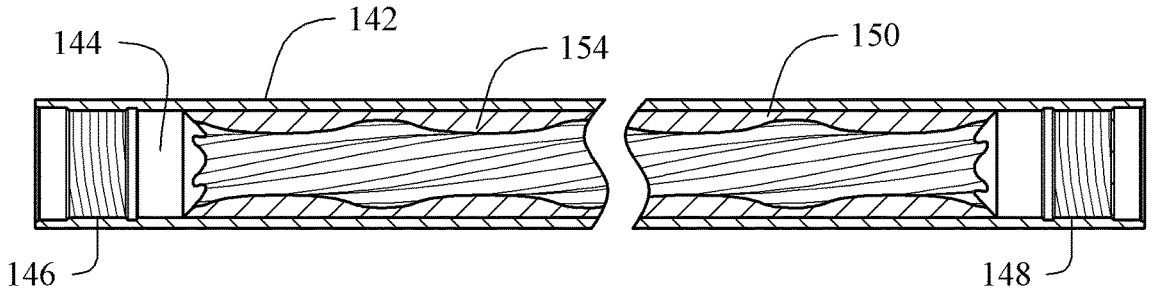
FIG. 15 is a cross-sectional view of the stator housing and stator of the present technology, taken along line 15-15 in FIG. 14.

Referring to FIGS. 12-16, the rotor/stator assembly 140 includes a stator housing 142, a stator 150, and a rotor 160. The rotor/stator assembly 140 can be configured to be a progressing-cavity stator/rotor combination provides rotational power to turn the rotor relative to the stator. The stator housing 142, as best illustrated in FIGS. 12, 14 and 15, defines an axial stator housing bore or cavity 144 therethrough, and includes a first connection end 146 featuring internal threading capable of being engageable with the external threading of the second connection end 128 of the flex shaft housing 122, thereby joining the flex shaft housing 122 and the stator housing 142. It can be appreciated that seals can be utilized between the first connection end 146 of the stator housing 142 and the second connection end 128 of the flex shaft housing 122. A second connection end 148 of the stator housing 142, as best illustrated in FIGS. 13 and 15 can feature internal threading.

The stator 150 can be received in the stator housing bore 144 of the stator housing 142 and fittingly secured thereto, so that the stator 150 and stator housing 142 is substantially a single unit. The stator 150 can be a tubular extension defining an axial stator bore or cavity 152 therethrough, and extending in the longitudinal direction of the stator housing 142. The stator bore 152 is in communication with the stator housing bore 144, so as to receive fluid from the flex shaft housing cavity 124. The stator 150 can include multiple lobes 154 extending into the stator bore 152.

The rotor 160 includes a first connection end 162 featuring internal threading capable of being engageable with the external threading of the second connection end 138 of the flex shaft 130, thereby joining the flex shaft 130 and the rotor 160. It can be appreciated that seals can be utilized between the first connection end 162 of the rotor 160 and the second connection end 138 of the flex shaft 130.

Figure 16:
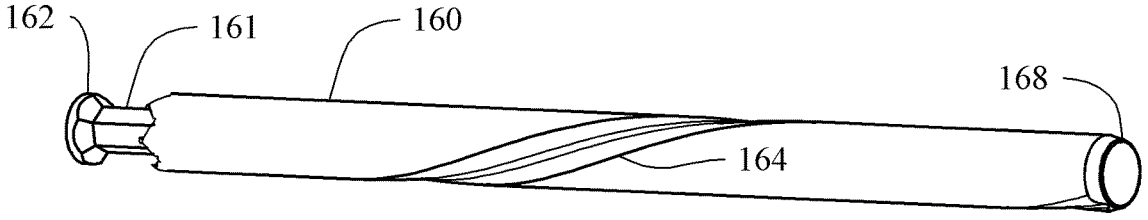
FIG. 16 is a perspective view of the rotor of the present technology.

As best illustrated in FIG. 16, the rotor 160 can include exterior planar surfaces 161 that can be part of or adjacent the first connection end 162, and a second end 168. The external planar surfaces 161 can be arranged to create a geometrical configuration capable of being engaged with a tool for installation, removal or manipulation of the rotor 160. One or more helical or spiral lobes 164 are configured along a part of a longitudinal length of the rotor 160.

The rotor 160 is slidably and rotatably received in the stator bore 152, with the lobes 154, 164 of the stator 150 and the rotor 160 being complimentary to or with each other. The complimentary configuration of the lobes 154, 164 is capable of rotation of the rotor 160 relative to the stator 150 responsive to a flow of fluid traveling through stator bore 152, as best illustrated in FIG. 13.

Figure 17:
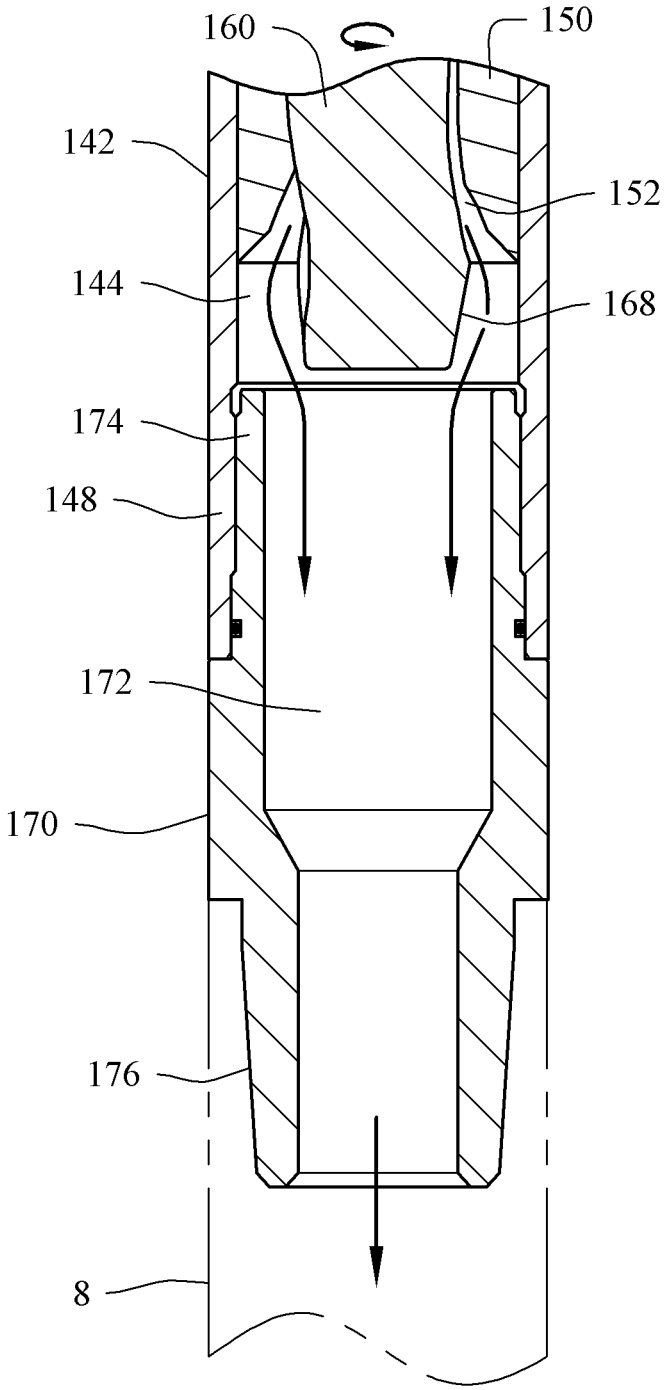
FIG. 17 is a cross-sectional view of the bottom sub of the present technology.

Referring to FIG. 17, the bottom sub 170 defines an axial bottom sub bore or cavity 172 therethrough, and includes a first connection end 174 featuring external threading capable of being engageable with the internal threading of the a second connection end 148 of the stator housing 142, thereby joining the stator housing 142 and the bottom sub 170. It can be appreciated that seals can be utilized between the first connection end 174 of the bottom sub 170 and the second connection end 148 of the stator housing 142.

The bottom sub 170 can include a pin connection end 176 capable of coupling with the BHA 8 or a drill motor top sub.

It can be appreciated that the bearing housing 82, the flex shaft housing 122, the stator housing 142 and/or the bottom sub 170 can be formed as integral housing units, with the top sub housing 14 being attachable thereto.

Figure 18:
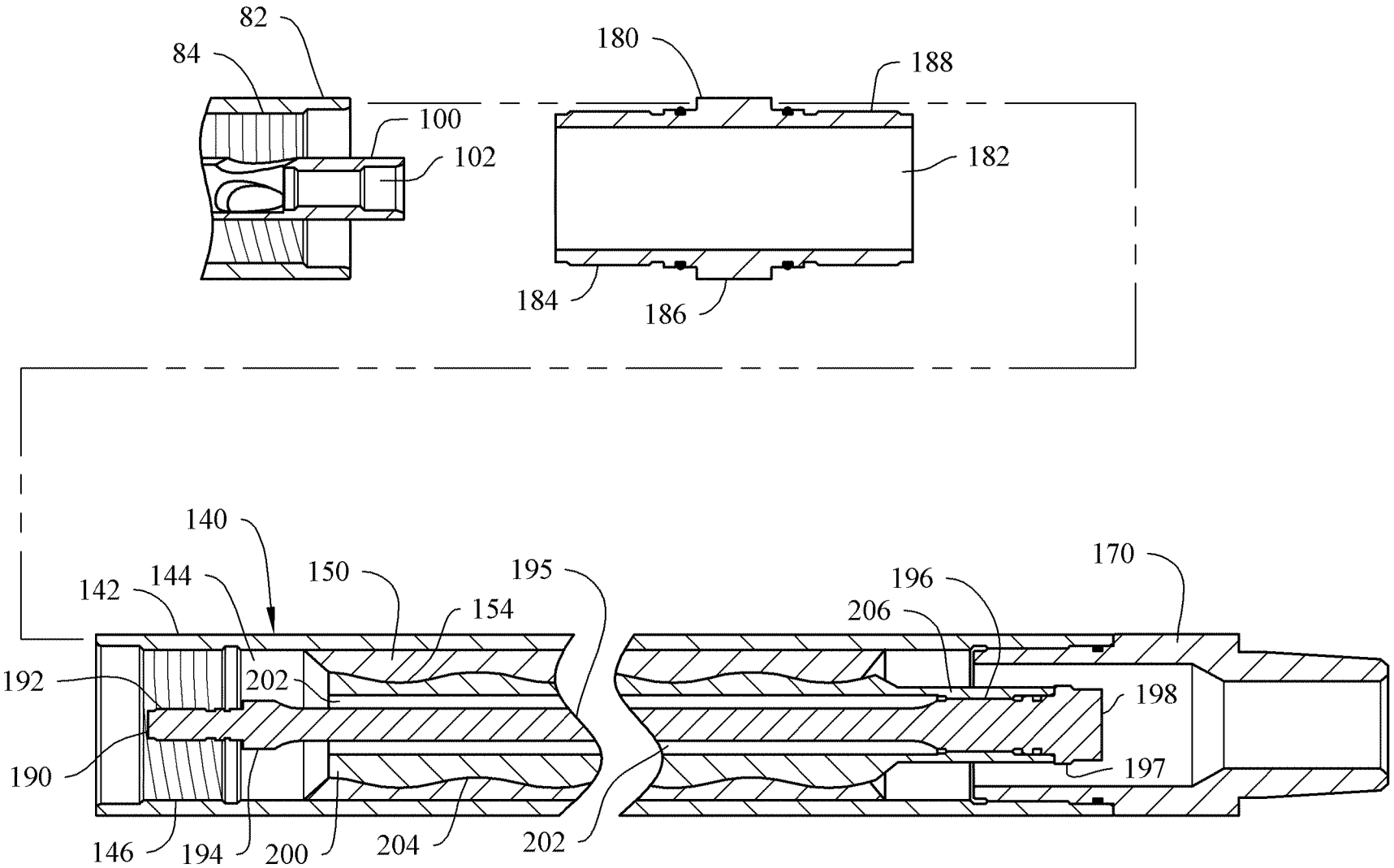
FIG. 18 is a cross-sectional view of an alternate embodiment rotor/stator assembly including an alternate flex shaft and rotor of the present technology.

Referring to FIG. 18, some embodiments of the present technology can include alternate embodiment rotor/stator assembly 160 including an alternate flex shaft housing 180, flex shaft 190 and rotor 200. This alternate embodiment rotor/stator assembly 160 can reduce the size of the flex shaft housing, thereby consolidating the system and reducing weight. In some cases, the flexi shaft housing can be eliminated.

The flex shaft housing 180 can be reduced essentially becoming a coupler including an axial coupler bore or cavity 182 defined therethrough, a first connection end 184, a main section 186, and a second connection end 188. The first connection end 184 can feature external threading capable of being engageable with the internal threading of the second connection end 86 of the bearing housing 82, thereby joining the bearing housing 82 and the flex shaft housing 180. It can be appreciated that seals can be utilized between the first connection end 184 of the flex shaft housing 180 and the second connection end 86 of the bearing housing 82.

The main section 186 can be configured to be engaged by a tool for installation, removal or manipulation of the flex shaft housing 180.

The second connection end 188 can feature external threading capable of being engageable with the internal threading of the first connection end 146 of the stator housing 142, thereby joining the stator housing 142 and the flex shaft housing 180. It can be appreciated that seals can be utilized between the second connection end 188 of the flex shaft housing 180 and the first connection end 146 of the stator housing 142.

The alternate flex shaft 190 can include a first connection end 192 featuring external threading, a shaft section 195, and a second connection end 198. The second connection end 198 or a portion adjacent thereto can include external threading 196, and a lip or flange 197 extending outward from an exterior the second connection end 198. It can be appreciated that the lip 197 can be a radial lip or at least one projection or tab. The lip 197 has a diameter or height sufficient to produce a stop edge.

The alternate rotor 200 includes an axial rotor bore or cavity 202 defined therethrough and configured to receive the first connection end 192 and the shaft section 195 of the flex shaft 190. The rotor 200 includes a first open end, and a second connection end 206 featuring internal threading capable of being engageable with the external threading 196 of the second connection end 198 of the flex shaft 190, thereby joining the flex shaft 190 and the rotor 200. It can be appreciated that seals can be utilized between the second connection end 198 of the flex shaft 190 and the second connection end 206 of the rotor 200. One or more helical or spiral lobes 204 are configured along a part of a longitudinal length of the rotor 200, with the lobes 154, 204 of the stator 150 and the rotor 200 being complimentary to or with each other.

When assembled, the lip 197 of the second connection end 198 can contact the second connection end 206 of the rotor 200. The lip 197 has a diameter or height sufficient to produce a stop edge that can contact or abut the second connection end 206 of the rotor 200 when assembled.

It can be appreciated that the flex shaft 190 can include exterior planar surfaces 194 that are engageable by a tool for installation, removal or manipulation of the flex shaft 190. The exterior planar surfaces 194 can be part of or adjacent with the first connection end 192 of the flex shaft and/or part of the second connection end 198.

In use, it can now be understood that pressurized fluid flowing through the progressing-cavity stator/rotor combination provides rotational power to turn the rotor relative to the stator. The stator is rigidly connected to the BHA, either directly or by way of the stator housing.

In general and in the exemplary, the downhole pulsation system 10 is assembled, with the valve sub housing 14 connected in series to the drill string 2, and the stator housing 142 or bottom sub 170 connected to the BHA 8. The drill string 2, downhole pulsation system 10 and the BHA 8 are introduced and advanced through the wellbore 6 for downhole operations. Working fluid is pumped through the drill string 2, which enters the valve sub assembly 12, through the mandrel cap 50 and then through the mandrel 90. The working fluid then travels through an annulus associated exterior of the flex shaft 130, and then enters the rotor/stator assembly 140. Upon which, nutation and rotation is imparted onto the rotor 160, which consequently rotates the mandrel cap 50. Rotation of the mandrel cap 50 thus rotates the ports 46, 62 in and out of obstruction with the lobe feature 34 or the lobed insert 30. This intermittent obstruction creates a pressure pulse within the system and consequently translates to mechanical vibration, pulsation or vibration of the drill string 2 and/or BHA 8.

Under normal operation, being that the progressing-cavity stator/rotor are effectively positive displacement, the rotor will rotate at a rate that is proportional to the volumetric rate of flow travelling between it and the stator, assuming fluid is effectively incompressible.

The rotor is rotationally coupled to the ported mandrel assemble (PMA) by way of the flex shaft. The PMA can include the mandrel, the mandrel cap and associated components.

The PMA is constrained by means of the bearings that permit rotation but limit axial and radial movement. Thus, the mandrel can rotate concentrically within the bearing housing that is rigidly connected in series with the stator and the rest of the BHA.

The flex shaft undergoes nutation as well as rotation at one end due to the rotor's complex motion. At its other end, it delivers pure concentric rotation to the mandrel. In some embodiments, this can be accomplished with the flex shaft having sufficient transverse flexibility. It can be appreciated that other types of drive shafts can be utilized in place of the flex shaft.

Depending on the embodiment, most or all the BHA's fluid flow passes through the port(s) of the mandrel. The port(s) provides a pathway for fluid communication from the annular space, formed between the bearing housing and mandrel, and the interior of the mandrel. The interior of the mandrel cap and the mandrel provides a continuous pathway for fluid flow to continue through to the remaining BHA.

One or more lobe features of the lobed insert, which is rigidly connected to the top sub housing within which the mandrel cap rotates, are in axial alignment with the port(s) of the mandrel cap. As the PMA rotates, the port(s) of the mandrel cap pass by the lobe feature(s) of the constrained lobed insert. The lobe feature(s) is large enough and in sufficient radial proximity to the port(s), to significantly obstruct the passage of fluid into the port(s), as they pass by during rotation.

The lobe feature(s) has a cylindrical surface that is oriented concentrically with respect to the PMA's rotation axis. The port(s) resides on a cylindrical surface that is oriented concentrically with respect to the PMA's rotation axis.

The cyclic obstruction of the port(s) leads to a fluctuating total flow area (TFA). The TFA is at a maximum while the port(s) is completely unobstructed by a lobe feature. The TFA is at a minimum while being fully obstructed by a lobe feature. The cyclic variation of TFA from its maximum to minimum condition causes a pressure spike within the fluid upstream of the port(s). This phenomenon is commonly referred to as "Water Hammer".

The flow rate through the port(s) achieves a maximum ($Q_{max}$) while fully unobstructed and reaches a minimum ($Q_{min}$) while fully obstructed. The magnitude of the pressure spike is proportional to the difference between the maximum and minimum flow rate ($\Delta Q=_{max}-Q_{min}$).

The time-averaged flow rate through the port(s) is dependent on the pump rate at surface, which supplies the fluid downhole. Increasing the pump rate increases $\Delta Q$, which in turn increases the pressure spike magnitude.

The rotor's rotational speed is dependent on the pump rate at surface. Increasing the pump rate increases the rotor's rotational speed. Being that the PMA is rotationally coupled to the rotor, increasing the pump rate will increase the pressure spike frequency.

The magnitude of the pressure spike is also proportional to the "system's" hydraulic impedance, which, from an internal pressure perspective, is a measure of the "system's" rigidity. Hydraulic impedance is generally defined as the ratio of pressure to volume flow rate. The pressure and volume flow variables are treated as phasors in this definition, so possess a phase as well as magnitude. The "system" consists of the upstream fluid itself as well as the tubular components (coiled tubing, etc.) though which the upstream fluid is conveyed. The length of the "system" is the product of the "system's" effective speed of sound and the duration of time that the port(s) is obstructed.

In some embodiments, the rotor/stator assembly connects in series into or to the BHA, and does not require any input from other BHA components other than fluid communication.

The bearings associated with the PMA can be cooled and lubricated via bypass fluid flow. The amount of fluid permitted to bypass can be controlled by fluid restrictors. The bypass flow rate ($Q_{bp}$) is substantially smaller than $Q_{min}$.

Some embodiments of the present technology can utilize a dropped ball or plug 11, as best illustrated in FIG. 7A, wherein the ball 11 activates via the provision of a ball seat defined by the narrowing cavity section 51 of the mandrel cap 50, located at the upstream end of the PMA that defines an opening to a fluid pathway in communication with the PMA's port.

The utilization of a ball 11 can provide an Inactive mode in the absence of a ball and an Active mode in the presence of the ball. In the Inactive mode, the PMA's TFA remains relatively large, even as the port(s) is obstructed. As such, the pressure spike amplitude generated by obstruction of the port(s) is attenuated. In the Active mode, once the ball is seated against the ball seat, the fluid pathway is closed thereby ceasing the attenuation.

The ball 11 that can be dropped or pumped through the wellbore tubulars or coiled tubing 2 to activate a downhole tool or device. The ball 11 can be, but not limited to, a hard non-dissolvable ball, a deformable ball, a dissolvable ball or a destroyable ball. Utilizing a deformable, a dissolvable or a destroyable ball can allow for controlled operation of rotating the mandrel cap 50 and mandrel 90, by obstructing the majority of the fluid flow through the axial cavity of the mandrel cap 50 and mandrel 90 and thus through the stator and rotor assembly 140. When agitation is required, pressure could be increased to deform the ball through the narrowing cavity section 51 of the mandrel cap 50 allowing the ball 11 to travel until contact is made with the first connection end 132 of the flex shaft 130. Alternatively, the ball 11 can be made of a dissolvable material that is configured to dissolve by the fluid after a predetermined time.

In some embodiments, the PMA can be driven by a rotor of a drilling motor situated directly downstream of the present technology system. The drilling motor's rotor catch function should be retained. For this reason, the flex shaft is rotationally coupled to a modified rotor catch device rather than directly to the rotor itself. As well, the flex shaft housing threadably connects to a top sub of the drilling motor rather than the stator itself. The top sub of the drilling motor can furnish an internal shoulder feature, which is essential to the rotor catch function.

The PMA bearings of the present technology are configured to not axially constrain or limit the axial movement of the rotor, which is already constrained by a bearing pack of the drilling motor. As such, an expansion/retraction (telescoping) feature can be provided at some location in between the rotor and the PMA's bearings.

Some embodiments of the present technology can include the rotor/stator assembly as being installed in series within an existing drilling motor, which does not require modifications to any of the drilling motors components. The PMA is rigidly connected in series with a flex shaft and bearing mandrel of the drilling motor. Therefore, the PMA does not require dedicated bearing support since the bearing mandrel is already well supported by the drilling motor's bearings.

Further, because the PMA is rigidly connected to the flex shaft, its rotation is provided via the drilling motor's power section. For this reason, a dedicated means of rotating the PMA, such as a dedicated power section and/or driveshaft, is not required either.

As a further consequence of being rigidly connected in series with the flex shaft and bearing mandrel of the drilling motor, the PMA can be of sufficient torsional strength to reliably transmit the relatively high torque that a drilling motor's drive-line is subject to.

If the drilling motor is of the sealed bearing variety, all fluid flow will pass through the PMA's port(s). If the drilling motor is of the "mud-lube" variety, then some fluid flow will bypass through the motor's bearing stack.

A housing, threadably connected between the flex shaft and bearing mandrel of the drilling motor, of make-up length corresponding to the PMA's make-up length can be provided to maintain correct alignment of the drilling motor's drive-line components. As well, this housing can provide a means to secure the lobe feature(s).

It can be appreciated that the PMA may terminate any pre-existing flow paths leading from the drive-shaft. For example, often flow is routed to the bearing mandrel's central flow pathway via substantially radial ports located on the drive-shaft.

In some embodiment, the radial clearance between ported sleeve and lobed insert controls pulsation magnitude being: a smaller clearance=larger pulsation magnitude; and a larger clearance=smaller pulsation magnitude.

The present technology can be configured accordingly: for larger pulsation amplitude: install a ported sleeve with larger outer diameter (OD) to provide a smaller clearance; and for smaller pulsation amplitude: install a ported sleeve with smaller OD to provide a larger clearance.

The number of lobes of the stator and/or rotor can vary, depending on predetermined requirements or characteristics. For example, prior to deployment of the present technology down the wellbore, an operator can install a lobed insert with desired number of lobes. Generally, the number of lobe features of the lobed insert will be one or two. In the case of two lobes, they can be phased at 180°. It can be appreciated that the more lobes results in a higher frequency of pulsation.

Frequency of pulsations equals product of PMA's revolutions per second and number of lobe features of the lobe insert, assuming angular positioning of lobes and ports are such that all ports are obstructed simultaneously.

Number of ports of the ported sleeved and/or mandrel cap should not exceed number of lobe features of the lobe insert. Otherwise, a port will always be left unobstructed, leading to significant attenuation of pulsation magnitude.

The angular span of the lobe feature of the lobe insert can be configurable, by selecting a lobed insert having desired lobe angular span, with a larger angular span=larger pulsation amplitude. A larger lobe angular span reduces the length of time over which the port(s) of the ported sleeve is unobstructed. As such, $Q_{max}$ and, by extension, $\Delta Q$ will increase thereby increasing pulsation magnitude.

While a larger lobe span will increase pulsation amplitude, it will also increase the mean pressure drop across the tool. As such, the required pumping horsepower increases at any given flow rate.

Thus, it can be appreciated that the frequency of the pulsation created by the present technology can be adjusted and/or controlled easily by utilizing lobe inserts featuring specific lobe feature characteristics, and/or utilizing ported sleeves and mandrel caps having specific port(s) characteristics.

In some embodiments, the valve sub assembly of the present technology can replace the motor catch, and therefore the bottom section of the present technology will be the top section of the motor.

In some embodiments, the valve sub assembly of the present technology can be attachable to any known or standardized rotor/stator assembly, thereby proving controllable pulsation to existing units.

While embodiments of the downhole pulsation system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although reducing friction acting on a tool string by generating and utilizing pressure pulsations have been described, it should be appreciated that the downhole pulsation system and method herein described is also suitable for providing vibration to any part of a drill string or BHA.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A downhole pulsation system for utilization with a drill string, said system comprising:

a valve sub housing attachable to the drill string, the valve sub housing including a sub bore axially extending along a longitudinal axis therethrough and configured to allow fluid to pass therethrough;

a lobed insert fittable to said valve sub housing and locatable inside said sub bore, said lobed insert including an insert bore axially extending along a longitudinal axis therethrough and configured to allow fluid to pass therethrough, and at least one lobe feature extending into said insert bore;

a mandrel cap including a cap bore axially extending along a longitudinal axis therethrough and configured to allow fluid to pass therethrough, and at least one port defined through said mandrel cap in communication with said cap bore, said mandrel cap having a portion thereof rotatably receivable in said insert bore of said lobed insert so that said port is alignable with said lobe feature; and at least one drive linkage operably connecting said mandrel cap to a rotor of a rotor and stator assembly;

wherein said mandrel cap being rotated by said rotor to intermittently allow fluid or portion of the fluid to pass from said insert bore through said port.

2. The downhole pulsation system of claim 1 further comprising a mandrel connectable to said mandrel cap and said drive linkage, said mandrel including a mandrel bore axially extending along a longitudinal axis therethrough and configured to allow fluid to pass therethrough, and at least one mandrel port defined through said mandrel in communication with said mandrel bore and configured to allow fluid to pass from said mandrel bore to an annulus defined exterior of at least a portion of said mandrel defining said mandrel port.

3. The downhole pulsation system of claim 2, wherein said drive linkage is a drive shaft.

4. The downhole pulsation system of claim 3, wherein said drive shaft is configured to have a predetermined transverse flexibility characteristic.

5. The downhole pulsation system of claim 2, wherein said mandrel is rotatably supported inside said sub bore of said valve sub housing or inside an axial bore of a second housing that is attachable to said valve sub housing by way of one or more bearings.

6. The downhole pulsation system of claim 5 further comprising at least one seal element concentrically located exterior of said mandrel, said seal element being configured to prevent fluid from entering said annulus defining an exterior of said portion of said mandrel defining said mandrel port.

7. The downhole pulsation system of claim 1 further comprising at least one seal element configured to prevent fluid from entering an annulus downstream of said mandrel cap.

8. The downhole pulsation system of claim 1 further comprising a sleeve including a sleeve bore axially extending along a longitudinal axis therethrough, and at least one sleeve port defined through said sleeve in communication with said sleeve bore, said sleeve bore being configured to receive said portion of said mandrel cap defining said port so that said sleeve port is aligned with and in communication with said port of said mandrel cap when said sleeve is assembled on said mandrel cap.

9. The downhole pulsation system of claim 8 further comprising a collar including a collar bore axially extending along a longitudinal axis therethrough and configured to receive said mandrel cap and secure said sleeve in position on said mandrel cap.

10. The downhole pulsation system of claim 8, wherein said sleeve includes at least one notch defined in an end of said sleeve, said notch being configured to receive a member protruding from said mandrel cap to prevent rotation of said sleeve about said mandrel cap.

11. The downhole pulsation system of claim 8, wherein a narrowed section is configured in at least one selected from the group consisting of said sub bore, and said cap bore, said narrowed section being configured to restrict flow of fluid passing therethrough, respectively.

12. The downhole pulsation system of claim 1, wherein said lobe feature is a plurality of lobe features radially arranged and extending into said insert bore.

13. A downhole pulsation system for utilization with a drill string, said system comprising:

a valve assembly comprising:

a valve sub housing attachable to the drill string, the valve sub housing including a sub bore axially extending along a longitudinal axis therethrough and configured to allow fluid to pass therethrough;

a lobed insert fittable to said valve sub housing and locatable inside said sub bore, said lobed insert including an insert bore axially extending along a longitudinal axis therethrough and configured to allow fluid to pass therethrough, and at least one lobe feature extending into said insert bore; and a mandrel cap including a cap bore axially extending along a longitudinal axis therethrough and configured to allow fluid to pass therethrough, and at least one port defined through said mandrel cap in communication with said cap bore, said mandrel cap having a portion thereof rotatably receivable in said insert bore of said lobed insert so that said port is alignable with said lobe feature;

a mandrel connectable to said mandrel cap, said mandrel including a mandrel bore axially extending along a longitudinal axis therethrough and configured to allow fluid to pass therethrough from said cap bore, and at least one mandrel port defined through said mandrel in communication with said mandrel bore and configured to allow fluid to pass from said mandrel bore to an annulus defined exterior of at least a portion of said mandrel defining said mandrel port;

at least one drive linkage connectable to said mandrel;

a rotor connectable to said drive linkage, said rotor having at least one rotor lobe; and a stator including a stator bore axially extending along a longitudinal axis therethrough and configured to allow fluid to pass therethrough, and at least one stator lobe, said stator bore being configured receive said rotor;

wherein said mandrel cap being rotated by said rotor to intermittently allow fluid or portion of the fluid to pass from said insert bore through said port.

14. The downhole pulsation system of claim 13, wherein said drive linkage is a drive shaft having a configuration capable of undergoing nutation and rotation resulting from said rotor.

15. The downhole pulsation system of claim 13, wherein said mandrel is rotatably supported inside said sub bore of said valve sub housing or inside an axial bore of a second housing that is attachable to said valve sub housing by way of one or more bearings.

16. The downhole pulsation system of claim 13 further comprising at least one seal element configured to prevent fluid from entering said annulus.

17. The downhole pulsation system of claim 13 further comprising a sleeve including a sleeve bore axially extending along a longitudinal axis therethrough, and at least one sleeve port defined through said sleeve in communication with said sleeve bore, said sleeve bore being configured to receive said portion of said mandrel cap defining said port so that said sleeve port is aligned with and in communication with said port of said mandrel cap when said sleeve is assembled on said mandrel cap.

18. The downhole pulsation system of claim 17, wherein said sleeve includes at least one notch defined in an end of said sleeve, said notch being configured to receive a member protruding from said mandrel cap to prevent rotation of said sleeve about said mandrel cap.

19. The downhole pulsation system of claim 13, wherein said rotor including a rotor bore axially extending along a longitudinal axis therethrough and configured to receive at least a part of said drive linkage with an end portion of said drive linkage being connected to an end portion of said rotor.

20. A method of creating drill string pulsation utilizing a downhole pulsation system, said method comprising the steps of:

a) receiving a working fluid to a sub bore axially defined along a longitudinal axis of a valve sub housing from an axial bore of a drill string coupled to said valve sub housing;

b) receiving the working fluid to a cap bore defined along a longitudinal axis of a mandrel cap that is rotatably received in an insert bore of a lobed insert located in said sub bore of said valve sub housing;

c) flowing the working fluid through said cap bore and to a mandrel bore axially defined along a longitudinal axis of a mandrel coupled to said mandrel cap;

d) flowing the working fluid from said mandrel bore through at least one mandrel port that is in communication with the mandrel bore and an annulus defined exterior of at least a portion of said mandrel defining said mandrel port;

e) rotating a rotor within a stator bore of a stator utilizing the flowing of the working fluid through said stator bore, said rotor being connected to said mandrel; and f) rotating said mandrel cap by rotation of said rotor so that a mandrel port is intermittently obstructed by a lobe feature of said lobed insert.

* * * * *